US005835828A

United States Patent [19]

Jyoroku

[11] Patent Number: 5,835,828

[45] Date of Patent: Nov. 10, 1998

[54] STIRRER AND TONER CARTRIDGE EQUIPPED WITH THE STIRRER

[75] Inventor: Kazuo Jyoroku, Osaka, Japan

[73] Assignee: Mita Industrial Co., Ltd., Osaka, Japan

[21] Appl. No.: 659,572

[22] Filed: Jun. 6, 1996

[30] Foreign Application Priority Data

Jun. 15, 1995 [JP] Japan ..... 7-148875

[51] Int. Cl.[6] ..... G03G 15/08

[52] U.S. Cl. ..... 399/256; 222/DIG. 1; 399/260; 399/263

[58] Field of Search ..... 399/254, 256, 399/258, 260, 262, 263; 222/DIG. 1

[56] References Cited

U.S. PATENT DOCUMENTS 4,926,217 5/1990 Bares ..... 399/254

4,980,724 12/1990 Tanaka ..... 399/256

5,298,952 3/1994 Kamijo et al. ..... 399/123

*Primary Examiner*—William J. Royer

*Attorney, Agent, or Firm*—Beveridge, DeGrandi, Weilacher & Young, L.L.P.

[57] ABSTRACT

A toner cartridge comprising a container having a toner discharge port, a toner contained in the container and a stirrer for stirring the toner existing in the container. The stirrer includes a rotary shaft rotatably mounted between both side walls of the container, not less than four arms extending in the radial direction from the rotary shaft at fixed distances in the axial direction and not less than three paddles disposed among the ends of the arms. The paddles are arranged at not less than three angular positions having angles different from each other and spaced at a distance apart in the circumferential direction.

6 Claims, 10 Drawing Sheets

STIRRER AND TONER CARTRIDGE EQUIPPED WITH THE STIRRER

FIELD OF THE INVENTION

The present invention relates to a stirrer for stirring powder such as toner and to a toner cartridge equipped with such a stirrer.

DESCRIPTION OF THE PRIOR ART

In electrostatic copiers, electrostatic printers and electrostatic facsimiles, an electrostatic latent image is formed on an electrostatic photosensitive material and is then developed into a toner image. A developing device for developing the electrostatic latent image into the toner image comprises a developing housing that accommodates a so-called one-component developing agent consisting of the toner only or a so-called two-components developing agent consisting of the toner and carrier particles, a developing agent application means for conveying the developing agent accommodated in the developing housing to a developing zone to apply it to the electrostatic photosensitive material, and a toner replenishing means for replenishing the developing housing with the toner. The toner replenishing means usually includes a toner cartridge which is detachably attached. A typical toner cartridge includes a container having a toner discharge port a toner contained in the container and a stirrer which stirs the toner existing in the container to prevent it from being agglomerated. In many cases, the stirrer has a function for conveying the toner in a required direction in addition to a function for stirring the toner. Such type of stirrer is constituted by a rotary shaft which is rotatably mounted extending between both side walls of the container, a plurality of arms being provided in the axial direction at a fixed distance and extending in a radial direction from the rotary shaft and a plurality of paddles arranged between the arms. The paddles are arranged at the positions of a single angle or at positions of two angles which are different from each other by 180 degrees. One end of the rotary shaft of the stirrer outwardly protrudes beyond the side wall of the container, and an input gear is attached to the protruding end. When the toner cartridge is mounted on a required position of the developing device, the input gear attached to the rotary shaft of the stirrer is drivably coupled to an electric motor via a transmission gear train, whereby the rotary shaft of the stirrer, arms and paddles are driven by the electric motor.

The above-mentioned conventional toner cartridge, however, has the following problem that must be solved. That is, since a plurality of paddles of the stirrer are arranged in a concentrated manner at the positions of a single angle or at the positions of two angles different from each other by 180 degrees, the torque required for rotating the rotary shaft of the stirrer once varies to a great extent. In other words, a considerably large torque is required. Therefore, a relatively expensive electric motor that produces a large output torque is required and, besides, the stirrer must be so designed as to possess a relatively high rigidity. Although the required maximum torque can be decreased by decreasing the effectively acting areas of the paddles for the toner, the efficiency of the toner stirring and conveying functions of the paddles decrease inevitably.

SUMMARY OF THE INVENTION

A first object of the present invention is to provide a novel and improved stirrer which requires a maximum rotational torque which is considerably smaller than that of the conventional stirrers without lowering the action of the paddles for stirring and feeding the powder such as toner.

A second object of the present invention is to provide a novel and improved toner cartridge which requires a maximum rotational torque which is considerably smaller than that of the conventional toner cartridges without lowering the action of the paddles for stirring and feeding the toner.

In order to accomplish the above-mentioned first and second objects according to the present invention, the stirrer has not less than four arms and not less than three paddles, the paddles being arranged at not less than three angular positions having angles different from each other and spaced at a distance apart in the circumferential direction.

In order to accomplish the above-mentioned first object according to a first aspect of the present invention, there is provided a stirrer comprising a rotary shaft, a plurality of arms extending in a radial direction from said rotary shaft at a fixed distance in the axial direction, and a plurality of paddles arranged between the ends of said arms, wherein said arms are arranged in a number of not less than four and said paddles are arranged in a number of not less than three, said paddles being arranged at not less than three angular positions having angles different from each other and spaced at a distance apart in the circumferential direction.

In order to accomplish the above-mentioned second object according to a second aspect of the present invention, there is provided a toner cartridge comprising a container having a toner discharge port, a toner contained in said container and a stirrer for stirring the toner existing in said container, said stirrer including a rotary shaft that is rotatably mounted extending between both side walls of said container, a plurality of arms extending in a radial direction from said rotary shaft at a fixed distance in the axial direction, and a plurality of paddles arranged between the ends of said arms, wherein said arms in said stirrer are arranged in a number of not less than four and said paddles are arranged in a number of not less than three, said paddles being arranged at not less than three angular positions having angles different from each other and spaced at a distance apart in the circumferential direction.

It is desired that the paddles extend substantially in parallel with the rotary shaft, the gaps between the paddles and the rotary shaft are substantially the same, and the paddles have substantially the same length in the axial direction. It is desired that the paddles are arranged at angular positions which are different from each other by an equal angle. The paddles may have a semicircular shape in transverse cross section. It is desired that the rotary shaft, arms and paddles are made of a synthetic resin material as a unitary structure. The paddles may be provided with a plate piece of a synthetic resin film extending from the paddles in a direction to separate away from the rotary shaft.

DETAILED DESCRIPTION OF THE PREFERRED EMBODIMENTS

The invention will now be described in further detail with reference to the accompanying drawings which illustrate preferred embodiments of a toner cartridge of the invention.

Figure 1:
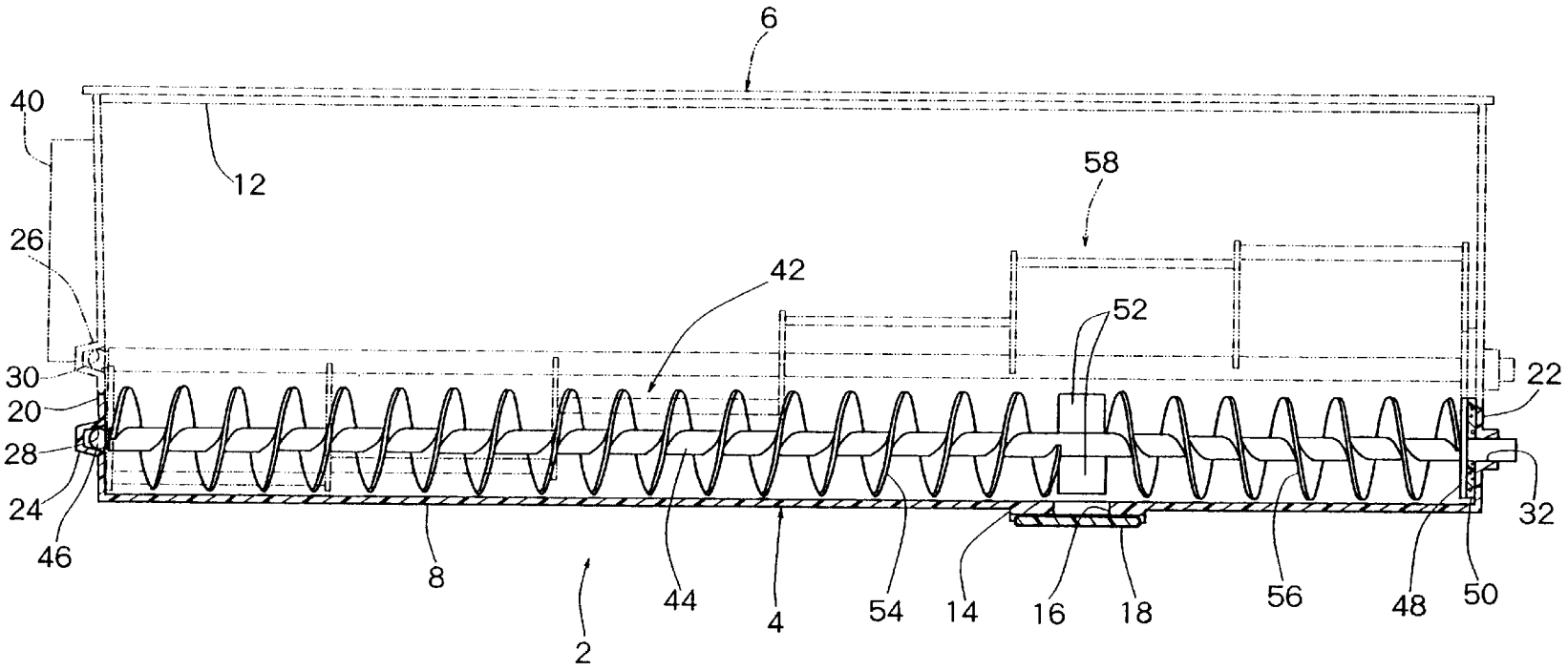
FIG. 1 is a sectional view in the axial direction of a toner cartridge constituted according to a preferred embodiment of the present invention but omitting the toner contained in a container.
Figure 2:
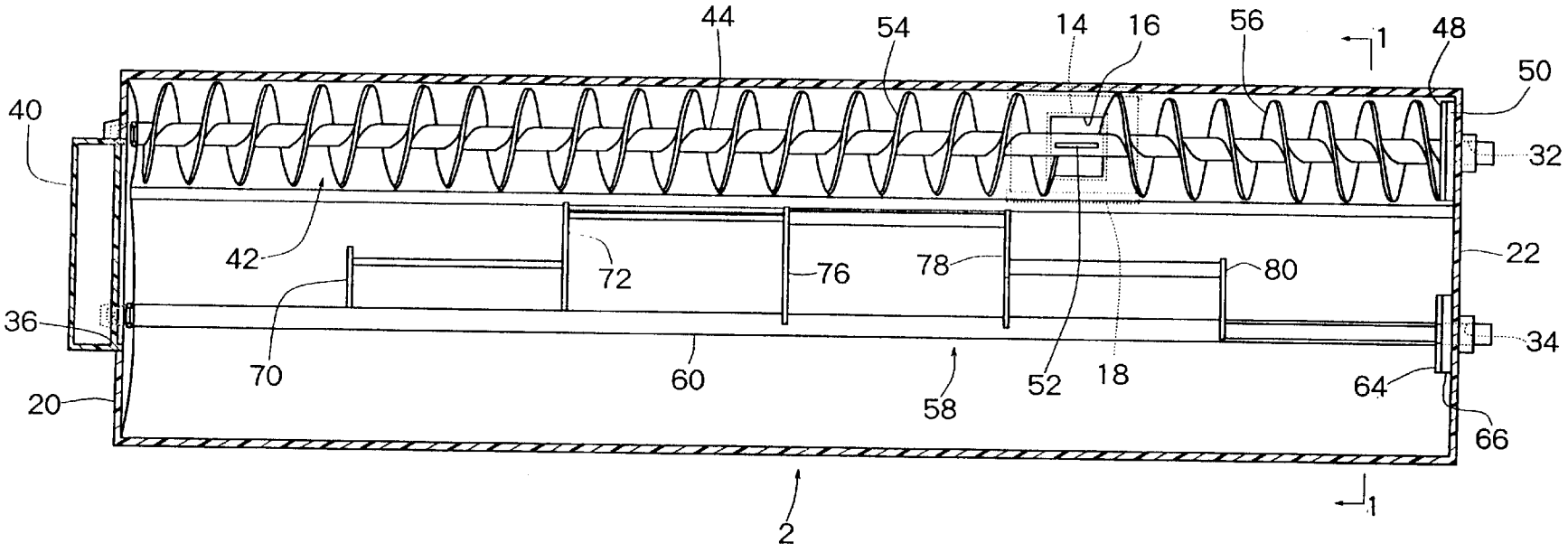
FIG. 2 is a plan view illustrating the toner cartridge shown in FIG. 1 but omitting an upper closure of the container and the toner contained in the container.
Figure 3:
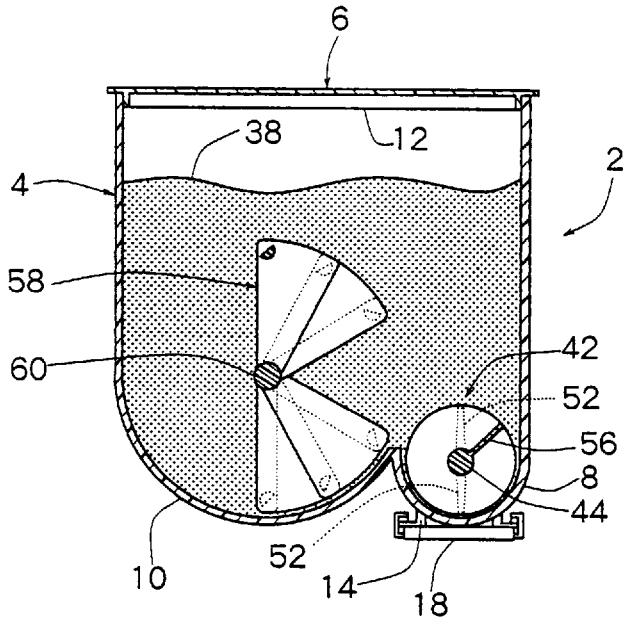
FIG. 3 is a transverse sectional view along the line 1—1 of FIG. 2.

With reference to FIGS. 1 to 3, the diagramed toner cartridge is equipped with a container that is generally designated at 2. The container 2 is constituted by a main member 4 and a closure member 6. The main member 4 that can be made of a suitable synthetic resin has the shape of a box with its upper surface open. As will be clearly understood with reference to FIG. 3, the bottom wall of the main member 4 is defined by two arcuate portions, i.e., a relatively small arcuate portion 8 and a relatively large arcuate portion 10 that are arranged in parallel in a transverse cross section. The closure member 6 which can similarly be made of a suitable synthetic resin has the shape of a flat plate and has on the lower surface thereof a protrusion 12 of a shape corresponding to a rectangular opening formed in the upper surface of the main member 4. The closure member 6 is positioned on the upper surface of the main member 4 with its protrusion 12 protruding inwardly of the main member 4, and is secured to the main member 4 by a suitable method such as ultrasonic welding to close the upper surface of the main member 4. In the arcuate portion 8 of the bottom wall is formed a downwardly protruding rectangular mouth portion 14 in which is formed a toner discharge port 16. The mouth portion 14 is equipped with a shutter member 18 which slides between a close position to close the toner discharge port 16 and an open position to open the toner discharge port 16 (the shutter member 18 may be constituted in a known form and its details are not described in this specification).

Figure 4:
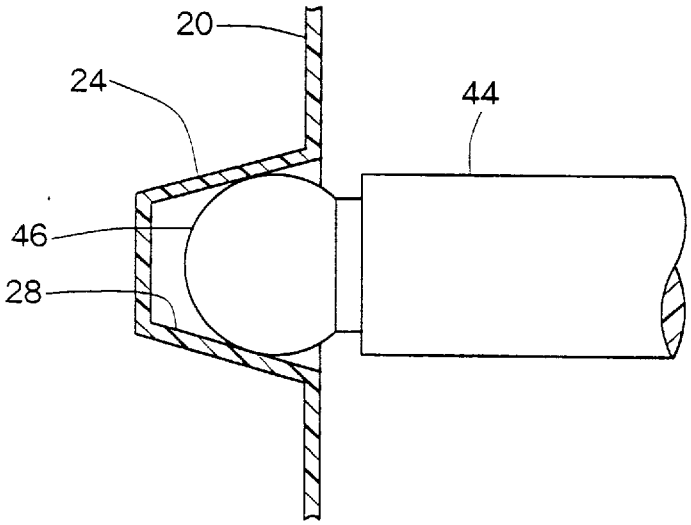
FIG. 4 is a partial sectional view illustrating a relationship between an end of a rotary shaft of a conveyer and a blind hole of the container in the toner cartridge shown in FIG. 1.

The main member 4 of the container 2 has both side walls 20 and 22. Two protruding portions 24 and 26 are formed on one side wall 20, and blind holes 28 and 30 are defined on the inside of the protruding portions 24 and 26. The blind holes 28 and 30 have the shape of a circular truncated cone with their inner diameter gradually increasing inwardly (reference should also be made to FIG. 4 showing blind hole 28). In the other side wall 22 are formed through holes 32 and 34 (FIG. 2) that correspond respectively to the blind holes 28 and 30. The blind hole 28 and the through hole 32 are positioned at the center of curvature of the arcuate portion 8 of the bottom wall, and the blind hole 30 and the through hole 34 are positioned at the center of curvature of the arcuate portion 10 of the bottom wall. In the side wall 20 is further formed a relatively large circular opening 36 (FIG. 2). Through the opening 36, the container 2 is filled with a toner 38 in an required amount (FIG. 3). After the container is filled with the toner 38, a closing member 40 is fitted to the side wall 20 by welding, bonding or the like to thereby close the opening 36.

With further reference to FIGS. 1 to 3, the container 2 contains a toner conveyer 42 arranged on the arcuate portion 8 of the bottom wall. The conveyer 42 includes a rotary shaft 44. As clearly shown in FIG. 4, one end 46 of the rotary shaft 44 is of a nearly spherical shape having a diameter which lies between a minimum inner diameter and a maximum inner diameter of the blind hole 28. Near the other end of the rotary shaft 44 is formed a circular flange 48. Furthermore, an annular sealing member 50 is fitted to the rotary shaft 44 on the outer side of the circular flange 48. The sealing member 50 may be made of a soft sponge. The rotary shaft 44 is inserted, at its nearly spherically shaped one end 46, in the blind hole 28 formed in the side wall 20 of the container 2 as shown in FIG. 4 and the whole rotary shaft 44 being elastically deformed to some extent is passed, at its other end, through the hole 32 formed in the side wall 22 of the container 22, whereby it is allowed to be rotatably mounted between the side walls 20 and 22. As will be easily comprehended with reference to FIG. 4, the blind hole 28 has the shape of a circular truncated cone, and the one end 46 of the rotary shaft 44 is nearly of a spherical shape. Therefore, the outer peripheral surface of the one end 46 of the rotary shaft 44 is brought into line contact, instead of surface contact, with the inner peripheral surface of the blind hole 28 irrespective of some machining error and, hence, excess of rotational resistance is never created by the frictional contact between the blind hole 28 and the one end 46 of the rotary shaft 44. When the other end of the rotary shaft 44 is passed through the hole 32, the circular flange 48 is positioned close to the inner surface of the side wall 22, the sealing member 50 is compressed to some extent between the circular flange 48 and the side wall 22. Thus, the sealing member 50 prevents the toner 38 from leaking out of the container through the hole 32. The other end of the rotary shaft 44 protrudes outwardly penetrating through the side wall 22, and an input gear (not shown) is fitted to the protruded end. When the toner cartridge is mounted on a required position of a developing device (not shown), the input gear is coupled to an electric motor (not shown) via a transmission gear train (not shown). When the electric motor is energized, the rotary shaft 44 is rotated in the clockwise direction in FIG. 3. As will be comprehended with reference to FIGS. 1 and 2, on the rotary shaft 44 are formed a pair of discharge vanes 52 and spiral vanes 54, 56. The pair of discharge vanes 52 are plate pieces which protrude in a radial direction from the rotary shaft 44 at an angular distance of 180 degrees relative to each other, and are located above a toner discharge port 16 formed in the arcuate portion 8 of the bottom wall. The spiral vane 54 extends between the side wall 20 and the discharge vanes 52, while the spiral vane 56 extends between the side wall 22 and the discharge vanes 52. The spiral direction of the spiral vane 54 is opposite to the spiral direction of the spiral vane 56. When the rotary shaft 44 rotates in the clockwise direction in FIG. 3, the spiral vane 54 carries the toner 38 rightwardly toward the discharge vanes 52 in FIGS. 1 and 2, and the spiral vane 56 carries the toner 38 leftwardly toward the discharge vanes 52 in FIGS. 1 and 2. The discharge vanes 52 cause the toner 38 to fall down from the container 2 through the toner discharge port 16 that is opened. Thus, the toner 38 is supplied from the toner cartridge to the developing device (not shown). It is desired that the rotary shaft 44, flange 48, discharge vanes 52 and spiral vanes 54, 56 of the toner conveyer 42 are molded as a unitary structure using a suitable synthetic resin.

The container 2 further contains a stirrer 58 located on the arcuate portion 10 of the bottom wall. With reference to FIG. 2 as well as FIGS. 5 and 6, the stirrer 58 includes a rotary shaft 60. One end 62, too, of the rotary shaft 60 is formed in a nearly spherical shape like the one end of the rotary shaft 44 of the conveyer 42, and has a diameter which lies between a minimum inner diameter and a maximum inner diameter of the blind hole 30. A circular flange 64 is formed near the other end of the rotary shaft 60, and an annular sealing member 66 is fitted to the rotary shaft 60 on the outer side of the circular flange 64. The sealing member 66 may be made of a soft sponge. The rotary shaft 60 is inserted, at its nearly spherically shaped one end 62, in the blind hole 30 formed in the side wall 20 of the container 2 like the rotary shaft 44 of the conveyer 42 and is passed, at its other end, through the hole 34 formed in the side wall 22 of the container 2, the whole rotary shaft 60 being elastically deformed to some extent, whereby it is allowed to be rotatably mounted between the side walls 20 and 22. Like that of the relationship between the one end 46 of the rotary shaft 44 and the blind hole 28 shown in FIG. 4, the blind hole 30 has the shape of a circular truncated cone, and the one end 62 of the rotary shaft 60 is nearly of a spherical shape. Therefore, the outer peripheral surface of the one end 62 of the rotary shaft 60 is brought into line contact, instead of surface contact, with the inner peripheral surface of the blind hole 30 irrespective of some machining error and, hence, excess rotational resistance is never created by the frictional contact between the blind hole 30 and the one end 62 of the rotary shaft 60. When the other end of the rotary shaft 60 is passed through the hole 34, the circular flange 64 is positioned close to the inner surface of the side wall 22, the sealing member 66 is compressed to some extent between the circular flange 64 and the side wall 22. Thus, the sealing member 66 prevents the toner 38 from leaking out of the container through the hole 34. The other end of the rotary shaft 60 protrudes outwardly penetrating through the side wall 22, and an input gear (not shown) is fitted to the protruded end. The input gear engages with a gear (not shown) fitted to the protruded end of the rotary shaft 44 of the conveyer 42. When the electric motor is energized to rotate the rotary shaft 44 of the conveyer 42 in the clockwise direction in FIG. 3, the rotary shaft 60 of the stirrer 58 rotates in the clockwise direction in FIG. 3.

Figure 5:
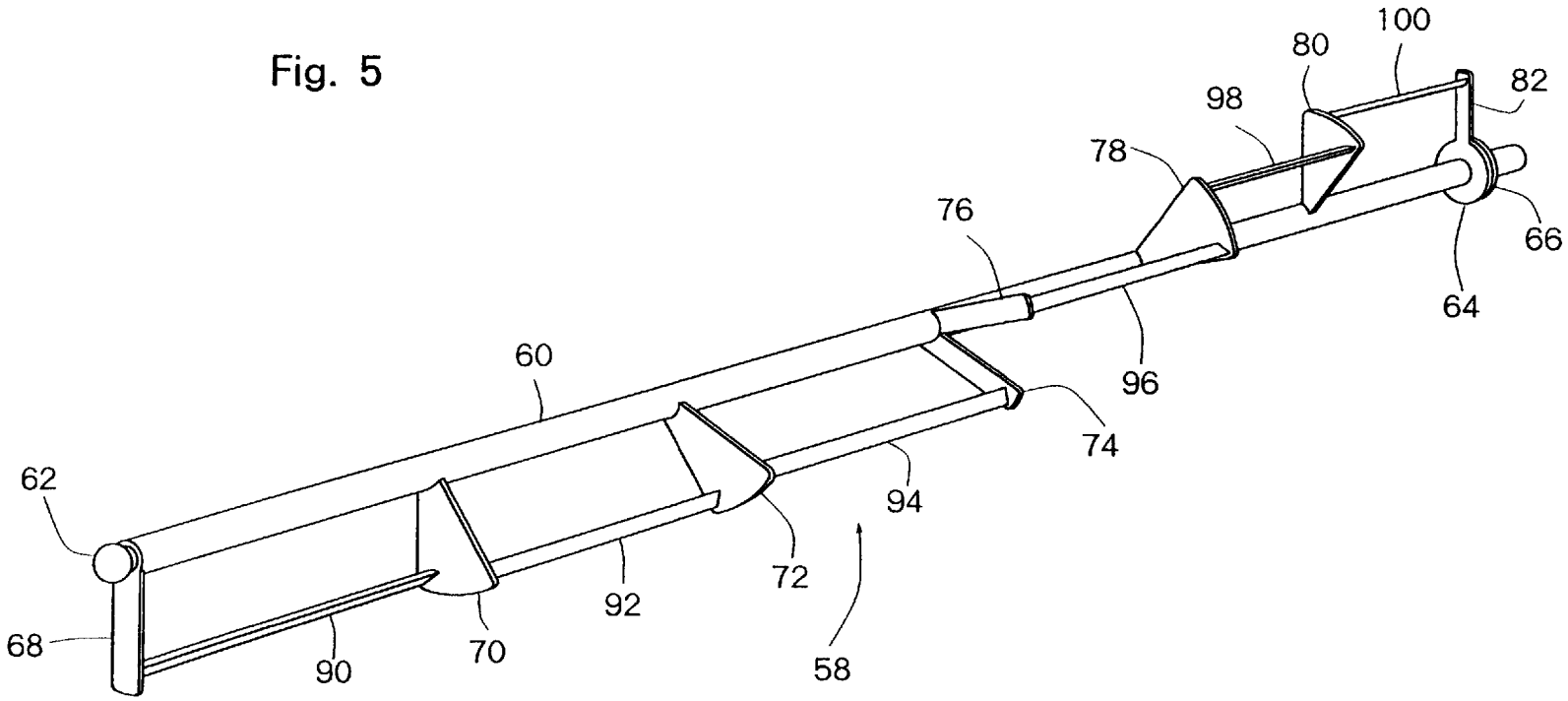
FIG. 5 is a perspective view illustrating a stirrer in the toner cartridge shown in FIG. 1.
Figure 6:
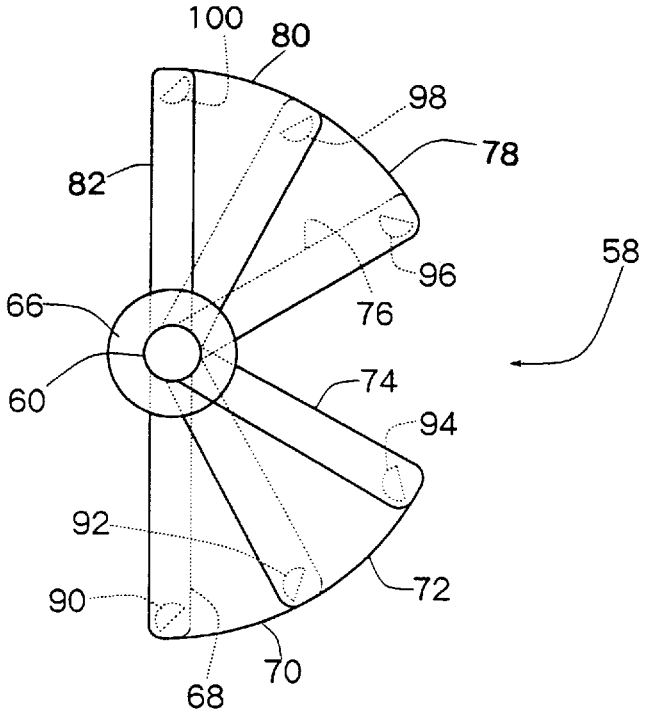
FIG. 6 is a side view illustrating the stirrer in the toner cartridge shown in FIG. 1.
Figure 7:
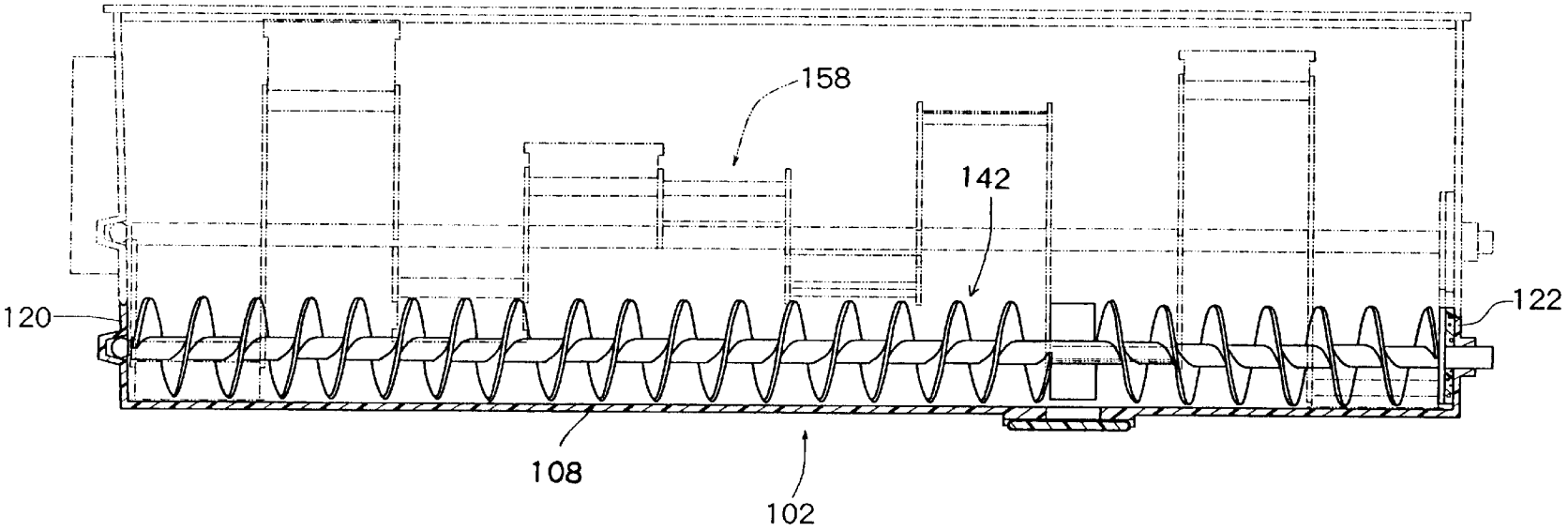
FIG. 7 is a sectional view in the axial direction of the toner cartridge constituted according to a modified embodiment but omitting the toner contained in the container.

With reference to FIG. 2 as well as FIGS. 5 and 6, on the rotary shaft 60 of the stirrer 58 are arranged eight arms 68, 70, 72, 74, 76, 78, 80 and 82 extending in the radial direction and maintaining an equal distance in the axial direction. The arms 68, 70, 72, 74, 76, 78 and 80 extend in the radial direction from the outer peripheral surface of the rotary shaft 60, but the arm 82 extends from the outer peripheral surface of the circular flange 64 formed on the rotary shaft 60. The arms 68 and 82 positioned at both ends of the rotary shaft 60 and the arms 74 and 76 positioned at the center of the rotary shaft 60 are strap pieces extending in the radial direction and have a width nearly equal to the outer diameter of the rotary shaft 60. As will be clearly understood from FIGS. 5 and 6, the arms 68, 74, 76 and 82 are disposed maintaining, in order, an angular distance of 60 degrees in the circumferential direction. The arms 70 and 72 located between the arms 68 and 74 and the arms 78 and 80 located between the arms 76 and 82 have the shape of a fan with their width gradually increasing outwardly in the radial direction. The arms 70 and 72 are arranged at a predetermined angular distance in the circumferential direction. One side of the arm 70 in the circumferential direction is in match with the arm 68, the other side of the arm 70 in the circumferential direction is in match with the one side of the arm 72 in the circumferential direction, and the other side of the arm 72 in the circumferential direction is in match with the arm 74. Similarly, the arms 78 and 80 are arranged at a predetermined angular distance in the circumferential direction. One side of the arm 78 in the circumferential direction is in match with the arm 76, the other side of the arm 78 in the circumferential direction is in match with the one side of the arm 80 in the circumferential direction, and the other side of the arm 80 in the circumferential direction is in match with the arm 82. The arms 68, 70, 72, 74, 76, 78, 80 and 82 have the same length in the radial direction. Paddles 90, 92, 94, 96, 98 and 100 are respectively fitted between the ends of the arms 68 and 70, between the ends of the arms 70 and 72, between the ends of the arms 72 and 74, between the ends of the arms 76 and 78, between the ends of the arms 78 and 80, and between the ends of the arms 80 and 82. As will be obvious from FIG. 6, the paddle 92 is disposed at an angular distance of 30 degrees from the paddle 90 in the counterclockwise direction in FIG. 6, the paddle 94 is disposed at an angular distance of 30 degrees from the paddle 92 in the counterclockwise direction in FIG. 6, the paddle 96 is disposed at an angular distance of 60 degrees from the paddle 94 in the counterclockwise direction in FIG. 6, the paddle 98 is disposed at an angular distance of 30 degrees from the paddle 96 in the counterclockwise direction in FIG. 6, and the paddle 100 is disposed at an angular distance of 30 degrees from the paddle 98 in the counterclockwise direction in FIG. 6. The paddles 90, 92, 94, 96, 98 and 100 have substantially the same length and a semicircular shape in transverse cross section. The paddles 90, 92, 94, 96, 98 and 100 each extend substantially in parallel with the rotary shaft 60. When brought to an angular position where the paddle 96 is located in FIG. 6, the flat surface of the paddle becomes nearly horizontal facing upwards. It is desired that the rotary shaft 60, flange 64, arms 68, 70, 72, 74, 76, 78, 80 and 82, and paddles 90, 92, 94, 96, 98 and 100 of the stirrer 58 are molded as a unitary structure using a suitable synthetic resin.

As will be understood with reference to FIG. 6 together with FIG. 3, when the stirrer 58 is rotated in the counterclockwise direction in FIG. 3, the flat surfaces of the paddles 90, 92, 94, 96, 98 and 100 act upon the toner 38 contained in the container 2 to stir it, and convey the toner 38 existing on the arcuate portion 10 of the bottom wall onto the upper part of the arcuate portion 8, i.e., onto the portion where the conveyer 42 is disposed. The paddles 90, 92, 94, 96, 98 and 100 are arranged not at the positions of the same angle but at six different angular positions at angular distances relative to each other in the circumferential direction. Therefore, the paddles 90, 92, 94, 96, 98 and 100 act upon the toner 38 at angular positions different from each other and under different conditions. A relatively large resistance acts upon the paddles 90, 92, 94, 96, 98 and 100 when the flat surfaces of the paddles 90, 92, 94, 96, 98 and 100 move downwardly to downwardly force the toner 38 toward the bottom wall of the container 2, while a relatively small resistance acts upon the paddles 90, 92, 94, 96, 98 and 100 when the flat surfaces of the paddles 90, 92, 94, 96, 98 and 100 move upwardly to upwardly force the toner 38. Since the paddles 90, 92, 94, 96, 98 and 100 are disposed at six different angular positions, variation of the rotational torque required for rotating the stirrer 58 once is considerably smaller than that of when the paddles are arranged at one or two angular positions in a concentrated manner, and the required maximum torque is also considerably decreased.

FIGS. 7 to 11 illustrate the toner cartridge constituted according to a modified embodiment of the present invention. As will be obvious from the comparison of FIG. 3 with FIG. 9, a one side portion 110 of the bottom wall is not of an arcuate shape but is defined by a linear central portion that extends substantially horizontally and by arcuate portions located on both sides thereof, and has a width larger than that of the arcuate portion 10 of the container 2.

Figure 8:
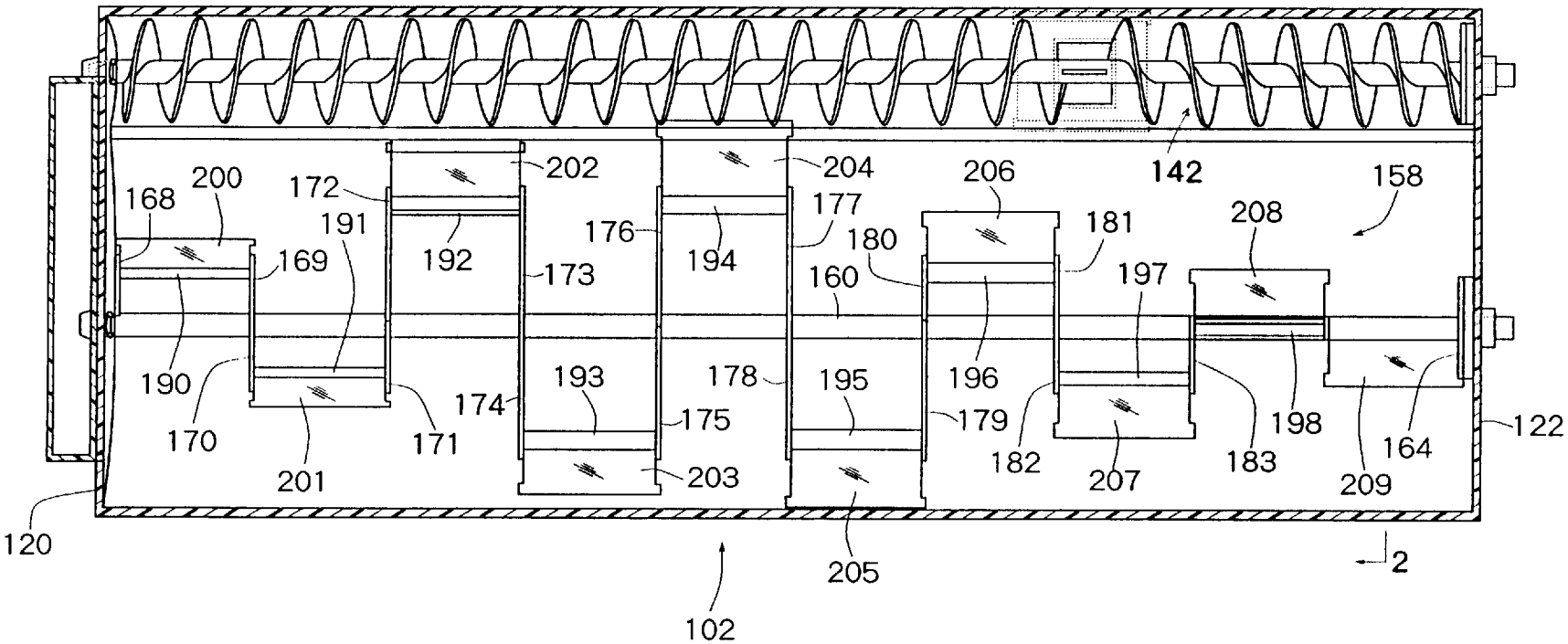
FIG. 8 is a plan view illustrating the toner cartridge sown in FIG. 7 but omitting the upper closure of the container and the toner contained in the container.
Figure 10:
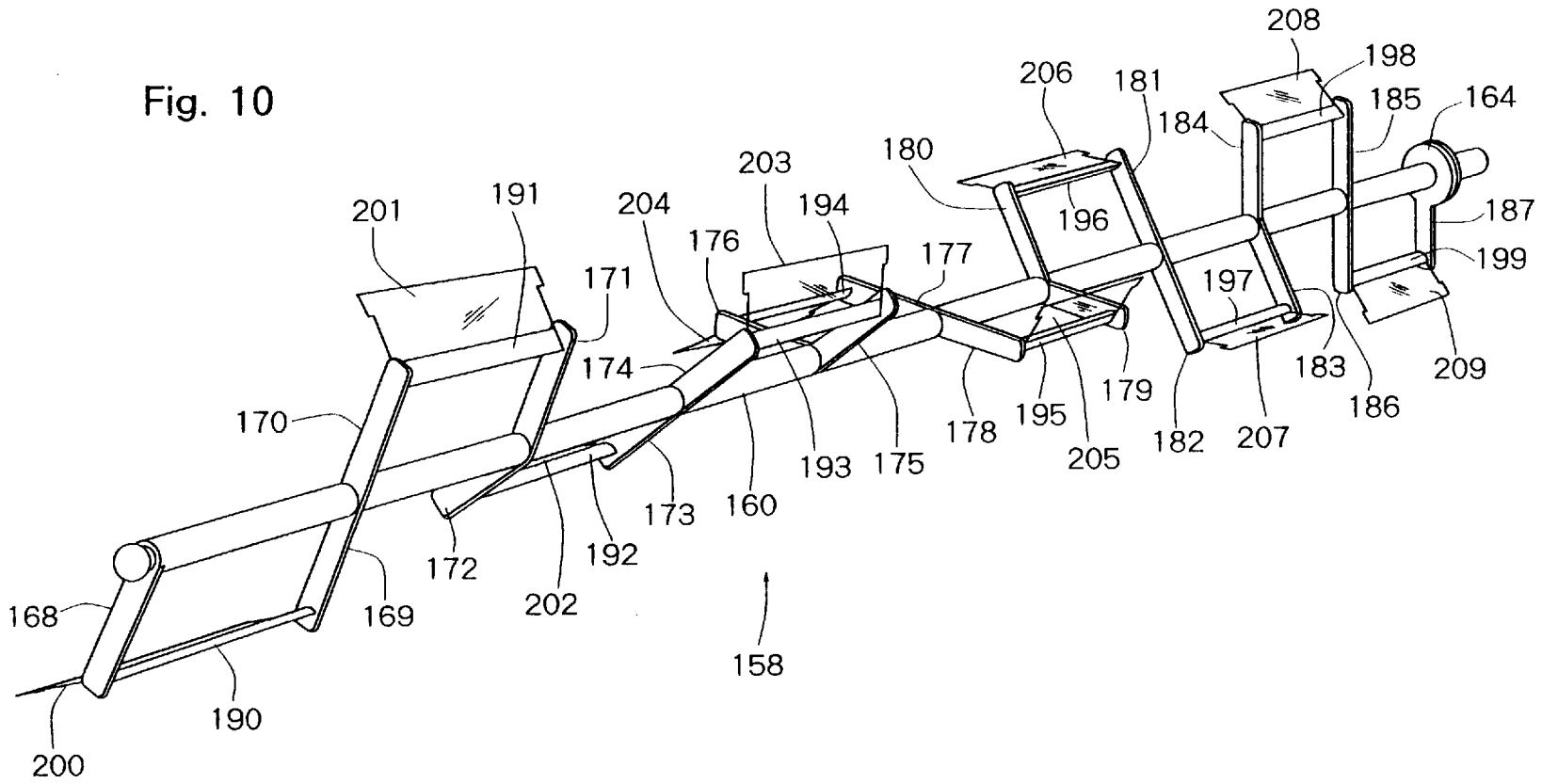
FIG. 10 is a perspective view illustrating the stirrer in the toner cartridge shown in FIG. 7.
Figure 11:
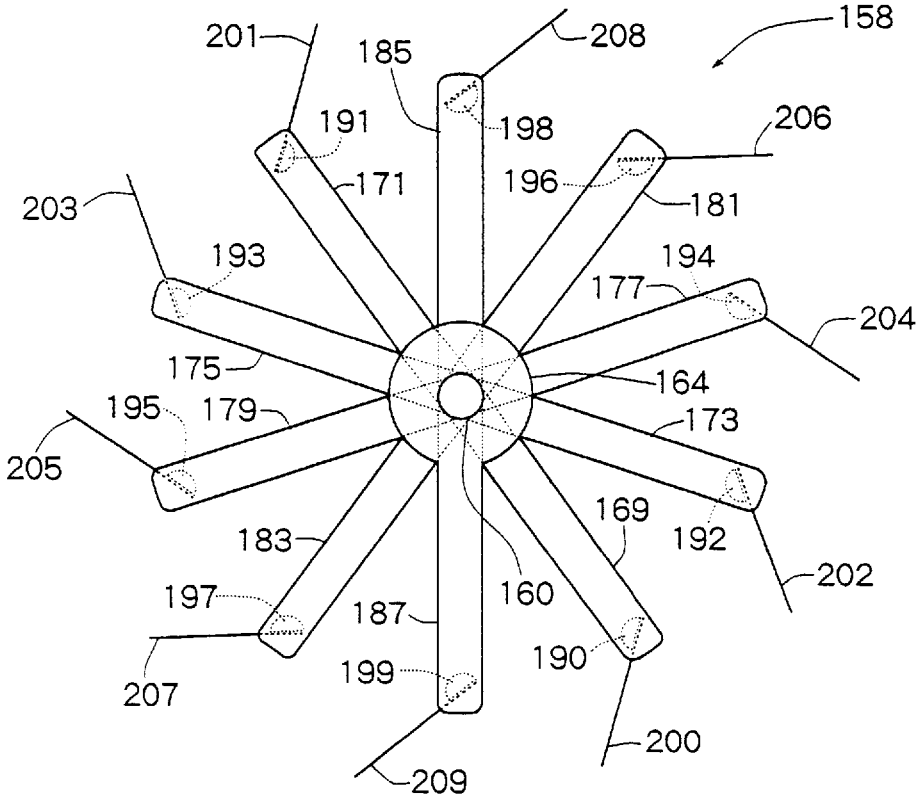
FIG. 11 is a side view illustrating the stirrer in the toner cartridge shown in FIG. 7.

With reference to FIGS. 8, 10 and 11, a stirrer 158 contained in the container 102 includes a rotary shaft 160 that extends on the above-mentioned side portion 110 of the bottom wall. The constitution of the rotary shaft 160 and the manner of mounting the rotary shaft 160 on both side walls 120, 122 of the container 102 are substantially the same as those of the case of the toner cartridge shown in FIGS. 1 to 6. However, the constitutions of arms and paddles of the stirrer 158 are different from the constitution of arms 68, 70, 72, 74, 76, 78, 80 and 82 and the constitution of the paddles 84, 86, 88, 90, 92 and 94 of the stirrer 58 shown in FIGS. 1 to 6. More specifically, the stirrer 158 has twenty arms 168, 169, 170, 171, 172, 173, 174, 175, 176, 177, 178, 179, 180, 181, 182, 183, 184, 185, 186 and 187 spaced at an equal distance in the axial direction. The arms 168, 169, 170, 171, 172, 173, 174, 175, 176, 177, 178, 179, 180, 181, 182, 183, 184, 185 and 186 extend in the radial direction from the outer peripheral surface of the rotary shaft 160, but the arm 187 extends in the radial direction from the outer peripheral edge of a circular flange 164 formed on the rotary shaft 160. The length from the center axis of the rotary shaft 160 to the ends of the arms 168, 169, 170, 171, 172, 173, 174, 175, 176, 177, 178, 179, 180, 181, 182, 183, 184, 185, 186 and 187 is substantially the same. The arms 168 and 169 are located at the same angular position, and a paddle 190 is disposed between the ends of the arms 168 and 169. The arms 170 and 171 are located at the same angular position, and a paddle 191 is disposed between the ends of the arms 170 and 171. The arms 170 and 171 are located at positions at an angular distance of 180 degrees with respect to the arms 168 and 169. Therefore, the paddle 191 is disposed at an angular distance of 180 degrees with respect to the paddle 190. The arms 172 and 173 are located at the same angular position, and a paddle 192 is disposed between the ends of the arms 172 and 173. The arms 172 and 173 are located at an angular distance of 36 degrees with respect to the arms 168 and 169 in the counterclockwise direction in FIG. 11. Therefore, the paddle 192 is disposed at an angular distance of 36 degrees with respect to the paddle 190 in the counterclockwise direction in FIG. 11. The arms 174 and 175 are located at the same angular position, and a paddle 193 is disposed between the ends of the arms 174 and 175. The arms 174 and 175 are located at positions at an angular distance of 180 degrees with respect to the arms 172 and 173. Therefore, the paddle 193 is disposed at an angular distance of 180 degrees with respect to the paddle 192. The arms 176 and 177 are located at the same angular position, and a paddle 194 is disposed between the ends of the arms 176 and 177. The arms 176 and 177 are located at an angular distance of 36 degrees with respect to the arms 172 and 173 in the counterclockwise direction in FIG. 11. Therefore, the paddle 194 is disposed at an angular distance of 36 degrees with respect to the paddle 192 in the counterclockwise direction in FIG. 11. The arms 178 and 179 are located at the same angular position, and a paddle 195 is disposed between the ends of the arms 178 and 179. The arms 178 and 179 are located at positions at an angular distance of 180 degrees with respect to the arms 176 and 177. Therefore, the paddle 195 is disposed at an angular distance of 180 degrees with respect to the paddle 194. The arms 180 and 181 are located at the same angular position, and a paddle 196 is disposed between the ends of the arms 180 and 181. The arms 180 and 181 are located at an angular distance of 36 degrees with respect to the arms 176 and 177 in the counterclockwise direction in FIG. 11. Therefore, the paddle 196 is disposed at an angular distance of 36 degrees with respect to the paddle 194 in the counterclockwise direction in FIG. 11. The arms 182 and 183 are located at the same angular position, and a paddle 197 is disposed between the ends of the arms 182 and 183. The arms 182 and 183 are located at positions at an angular distance of 180 degrees with respect to the arms 180 and 181. Therefore, the paddle 197 is disposed at an angular distance of 180 degrees with respect to the paddle 196. The arms 184 and 185 are located at the same angular position, and a paddle 198 is disposed between the ends of the arms 184 and 185. The arms 184 and 185 are located at an angular distance of 36 degrees with respect to the arms 180 and 181 in the counterclockwise direction in FIG. 11. Therefore, the paddle 198 is disposed at an angular distance of 36 degrees with respect to the paddle 196 in the counterclockwise direction in FIG. 11. The arms 186 and 187 are located at the same angular position, and a paddle 199 is disposed between the ends of the arms 186 and 187. The arms 186 and 187 are located at positions at an angular distance of 180 degrees with respect to the arms 184 and 185. Therefore, the paddle 199 is disposed at an angular distance of 180 degrees with respect to the paddle 198. Thus, the paddles 190, 192, 194, 196, 198, 191, 193, 195, 197 and 199 are successively disposed at an angular distance of 36 degrees. The paddles 190, 191, 192, 193, 194, 195, 196, 197, 198 and 199 have substantially the same length and a semicircular shape in transverse cross section. The paddles 190, 191, 192, 193, 194, 195, 196, 197, 198 and 199 extend substantially in parallel with the rotary shaft 160, and are so disposed that their flat surfaces become nearly horizontal facing upwards when they are brought to an angular position where the paddle 196 is located in FIG. 11. It is desired that the rotary shaft 160, flange 164, arms 168, 169, 170, 171, 172, 173, 174, 175, 176, 177, 178, 179, 180, 181, 182, 183, 184, 185, 186 and 187, as well as paddles 190, 191, 192, 193, 194, 195, 196, 197, 198 and 199 of the stirrer 158 are molded as a unitary structure using a suitable synthetic resin.

With reference to FIGS. 10 and 11, the paddles 190, 191, 192, 193, 194, 195, 196, 197, 198 and 199 of the stirrer 158 are provided with plate pieces 200, 201, 202, 203, 204, 205, 206, 207, 208 and 209, respectively. The plate pieces 200, 201, 202, 203, 204, 205, 206, 207, 208 and 209 are made of a suitable synthetic resin film such as polyethylene terephthalate film. The plate pieces 200, 201, 202, 203, 204, 205, 206, 207, 208 and 209 extend from the base portions where they are fitted to the flat surfaces of the paddles 190, 191, 192, 193, 194, 195, 196, 197, 198 and 199 by a suitable method such as bonding in a direction to separate away from the rotary shaft 160 in parallel with the flat surfaces of the paddles 190, 191, 192, 193, 194, 195, 196, 197, 198 and 199. The main portions of the plate pieces 200, 201, 202, 203, 204, 205, 206, 207, 208 and 209 have a width (in the axial direction of the rotary shaft 160) which is substantially equal to the length of the paddles 190, 191, 192, 193, 194, 195, 196, 197, 198 and 199. Here, the plate pieces 200, 201, 202, 203, 204, 205, 206, 207, 208 and 209 have at the ends thereof a pair of protruding portions protruding toward both sides thereof. The length of the protruding portions is slightly larger than the thickness of the arms 168, 169, 170, 171, 172, 173, 174, 175, 176, 177, 178, 179, 180, 181, 182, 183, 184, 185, 186 and 187 which support the paddles 190, 191, 192, 193, 194, 195, 196, 197 and 198.

Figure 9:
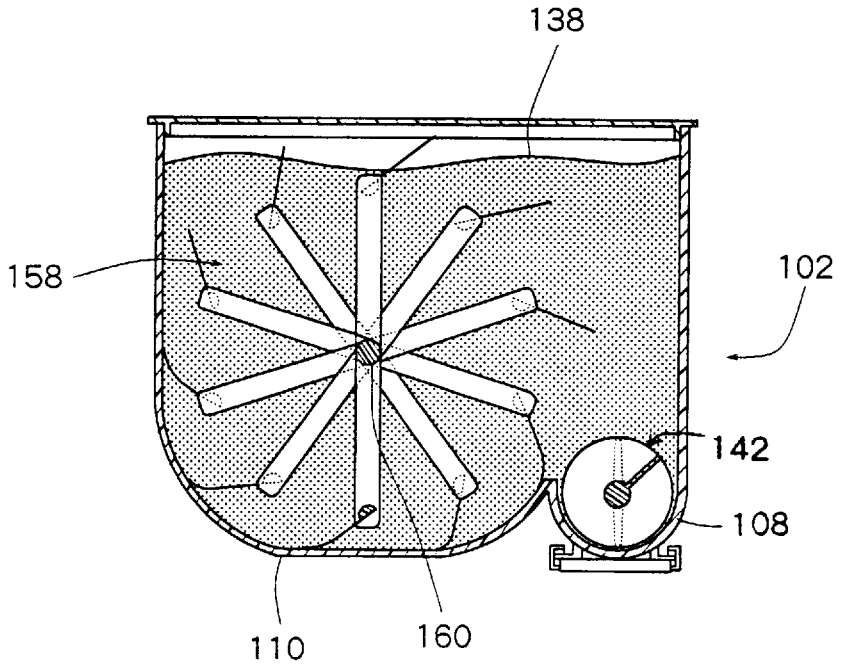
FIG. 9 is a transverse sectional view along the line 2—2 of FIG. 8.

In the toner cartridge shown in FIGS. 6 to 11 as will be understood with reference to FIG. 11 together with FIG. 9, when the stirrer 158 rotates in the counterclockwise direction in FIG. 9, the flat surfaces of the paddles 190, 191, 192, 193, 194, 195, 196, 197, 198 and 199 act upon the toner 138 contained in the container 102 to stir the toner 138, so that the toner 138 existing in portion 110 of the bottom wall is conveyed to the upper portion of the arcuate portion 108, i.e., conveyed to the portion where the conveyer 142 is disposed. The plate pieces 200, 201, 202, 203, 204, 205, 206, 207, 208 and 209 of the paddles 190, 191, 192, 193, 194, 195, 196, 197, 198 and 199 slide along the inner surface of the portion 110 of the bottom wall of the container 102 and the inner surface of the rear wall (wall located at the right end in FIG. 9) in order to prevent the toner 138 from staying on the inner surfaces. The loci described by the protruding portions formed at the ends of the neighboring plate pieces overlap one upon the other. Accordingly, the plate pieces 200, 201, 202, 203, 204, 205, 206, 207, 208 and 209 act upon the inner surface of the container 102 continuously in the axial direction of the rotary shaft 160. The paddles 190, 191, 192, 193, 194, 195, 196, 197, 198 and 199 are disposed not at the same angular position but at ten different angular positions at an angular distance of 36 degrees relative to one another. Therefore, the paddles 190, 191, 192, 193, 194, 195, 196, 197, 198 and 199 as well as the plate pieces 200, 201, 202, 203, 204, 205, 206, 207, 208 and 209 act upon the toner 138 at angular positions different from each other and under different conditions. A relatively large resistance acts upon the paddles 190, 191, 192, 193, 194, 195, 196, 197, 198 and 199 when the flat surfaces of the paddles 190, 191, 192, 193, 194, 195, 196, 197, 198 and 199 move downwardly to downwardly force the toner 138 toward the bottom wall of the container 102, and a relatively small resistance acts upon the paddles 190, 191, 192, 193, 194, 195, 196, 197, 198 and 199 when the flat surfaces of the paddles 190, 191, 192, 193, 194, 195, 196, 197, 198 and 199 move upwardly to upwardly force the toner 138. Since the paddles 190, 191, 192, 193, 194, 195, 196, 197, 198 and 199 are disposed at ten different angular positions, variation of the rotational torque required for rotating the stirrer 158 once is considerably smaller than that of when the paddles are arranged at one or two angular positions in a concentrated manner, and the required maximum torque is considerably decreaed.

In the foregoing were described preferred embodiments of the toner cartridge constituted according to the present invention with reference to the accompanying drawings. It should, however, be noted that the invention is in no way limited to such embodiments only but can be changed or modified in a variety of other ways without departing from the scope of the invention. Though the embodiments of the toner cartridge were described above in detail, the stirrer of the present invention can be used not only for stirring the toner in the toner cartridge but also for stirring the developing agent in the developing housing of a developing device and for stirring the powder in a device which deals with the powder other than the toner or the developing agent.

What I claim is:

1. A stirrer comprising:

a rotary shaft, a plurality of arms extending in a radial direction from said rotary shaft at fixed distances in the axial direction, and a plurality of paddles arranged between the ends of said arms, wherein said arms are arranged in a number of not less than four and said paddles are arranged in a number of not less than three, said paddles being arranged at not less than three angular positions having angles different from each other and spaced at a distance apart in the circumferential direction, and wherein said paddles have a semicircular shape in transverse cross section.

2. A stirrer comprising:

a rotary shaft, a plurality of arms extending in a radial direction from said rotary shaft at fixed distances in the axial direction, and a plurality of paddles arranged between the ends of said arms, wherein said arms are arranged in a number of not less than four and said paddles are arranged in a number of not less than three, said paddles being arranged at not less than three angular positions having angles different from each other and spaced at a distance apart in the circumferential direction, and wherein said rotary shaft, said arms and said paddles are molded as a unitary structure using a synthetic resin material.

3. A stirrer comprising:

a rotary shaft, a plurality of arms extending in a radial direction from said rotary shaft at fixed distances in the axial direction, and a plurality of paddles arranged between the ends of said arms, wherein said arms are arranged in a number of not less than four and said paddles are arranged in a number of not less than three, said paddles being arranged at not less than three angular positions having angles different from each other and spaced at a distance apart in the circumferential direction, and wherein said paddles are provided with plate pieces made of a synthetic resin film, which extend from said paddles in a direction to separate away from said rotary shaft.

4. A toner cartridge comprising:

a container having a toner discharge port, a toner contained in said container, and a stirrer for stirring the toner existing in said container, said stirrer including a rotary shaft that is rotatable mounted extending between both side walls of said container, a plurality of arms extending in a radial direction from said rotary shaft at fixed distances in the axial direction, and a plurality of paddles arranged between the ends of said arms, wherein said arms in said stirrer are arranged in a number of not less than four and said paddles are arranged in a number of not less than three, said paddles being arranged at not less than three angular positions having angles different from each other and spaced at a distance apart in the circumferential direction, and wherein said paddles have a semicircular shape in transverse cross section.

5. A toner cartridge comprising:

a container having a toner discharge port, a toner contained in said container, and a stirrer for stirring the toner existing in said container, said stirrer including a rotary shaft that is rotatable mounted extending between both side walls of said container, a plurality of arms extending in a radial direction from said rotary shaft at fixed distances in the axial direction, and a plurality of paddles arranged between the ends of said arms, wherein said arms in said stirrer are arranged in a number of not less than four and said paddles are arranged in a number of not less than three, said paddles being arranged at not less than three angular positions having angles different from each other and spaced at a distance apart in the circumferential direction, and wherein said rotary shaft, said arms and said paddles are molded as a unitary structure using a synthetic resin material.

6. A toner cartridge comprising:

a container having a toner discharge port, a toner contained in said container and, a stirrer for stirring the toner existing in said container, said stirrer including a rotary shaft that is rotatable mounted extending between both side walls of said container, a plurality of arms extending in a radial direction from said rotary shaft at fixed distances in the axial direction, and a plurality of paddles arranged between the ends of said arms, wherein said arms in said stirrer are arranged in a number of not less than four and said Paddles are arranged in a number of not less than three, said paddles being arranged at not less than three angular positions having angles different from each other and spaced at a distance apart in the circumferential direction, and wherein said paddles are provided with plate pieces made of a synthetic resin film, which extend from said paddles in a direction to separate away from said rotary shaft.

* * * * *